US006955223B2

(12) United States Patent
Orr et al.

(10) Patent No.: US 6,955,223 B2
(45) Date of Patent: Oct. 18, 2005

(54) BLOW OUT PREVENTER HANDLING SYSTEM

(75) Inventors: Alan Orr, Tulsa, OK (US); Rob Stauder, Tulsa, OK (US)

(73) Assignee: Helmerich & Payne, Inc., Tulsa, OK (US)

( * ) Notice: Subject to any disclaimer, the term of this patent is extended or adjusted under 35 U.S.C. 154(b) by 165 days.

(21) Appl. No.: 10/341,056

(22) Filed: Jan. 13, 2003

(65) Prior Publication Data

US 2004/0134666 A1 Jul. 15, 2004

(51) Int. Cl.[7] ..... E21B 19/00
(52) U.S. Cl. ..... 166/378; 166/85.4; 166/360
(58) Field of Search ..... 166/339, 364, 166/85.4, 77.51, 360, 359, 378, 379

(56) References Cited

U.S. PATENT DOCUMENTS

| | | | | | |
|---|---|---|---|---|---|
| 3,032,106 | A | | 5/1962 | Focht et al. | 166/46 |
| 3,435,906 | A | * | 4/1969 | Nicolson | 175/7 |
| 3,498,392 | A | * | 3/1970 | Knorr | 175/5 |
| 3,653,435 | A | | 4/1972 | Reistle, III et al. | 166/5 |
| 3,958,642 | A | | 5/1976 | Coone | 166/315 |
| 4,007,782 | A | | 2/1977 | Nybo et al. | 166/79 |
| 4,125,164 | A | | 11/1978 | Terry | 166/315 |
| 4,136,633 | A | | 1/1979 | Homer et al. | 114/264 |
| 4,147,221 | A | | 4/1979 | Ilfrey et al. | 175/7 |
| 4,291,762 | A | | 9/1981 | Gudgel | 166/85 |
| 4,359,089 | A | | 11/1982 | Strate et al. | 166/79 |
| 4,367,796 | A | | 1/1983 | Bolding | 166/341 |
| 4,399,873 | A | | 8/1983 | Lindsey, Jr. | 166/380 |
| 4,478,287 | A | * | 10/1984 | Hynes et al. | 166/341 |
| 4,668,126 | A | | 5/1987 | Burton | 405/169 |
| 4,899,832 | A | | 2/1990 | Bierscheid, Jr. | 173/23 |
| 4,995,762 | A | * | 2/1991 | Goldman | 405/195.1 |
| 5,116,095 | A | | 5/1992 | Kotrla | 294/94 |
| 5,816,565 | A | | 10/1998 | McGuffin | 254/386 |
| 6,068,069 | A | | 5/2000 | Scott et al. | 175/5 |
| 6,142,233 | A | * | 11/2000 | Wilkins | 166/339 |
| 6,227,300 | B1 | * | 5/2001 | Cunningham et al. | 166/339 |
| 6,276,450 | B1 | | 8/2001 | Seneviratne | 166/85.1 |
| 6,352,114 | B1 | * | 3/2002 | Toalson et al. | 166/343 |
| 6,412,554 | B1 | * | 7/2002 | Allen et al. | 166/80.1 |
| 6,474,412 | B2 | * | 11/2002 | Hamilton et al. | 166/77.51 |
| 6,494,268 | B1 | * | 12/2002 | Ljungdahl et al. | 166/379 |
| 6,591,913 | B2 | * | 7/2003 | Reaux et al. | 166/352 |
| 2002/0074125 | A1 | | 6/2002 | Fikes et al. | 166/352 |
| 2003/0159853 | A1 | | 8/2003 | Archibald et al. | 175/8 |

FOREIGN PATENT DOCUMENTS

| | | | |
|---|---|---|---|
| WO | WO 01/55550 | 8/2001 | E21B/33/04 |
| WO | WO 01/88331 | 11/2001 | E21B/34/04 |
| WO | WO 02/087959 | 11/2002 | |

* cited by examiner

*Primary Examiner*—David Bagnell
*Assistant Examiner*—Daniel Stephenson
(74) *Attorney, Agent, or Firm*—Head, Johnson & Kachigian

(57) ABSTRACT

A process to transport a blow out preventer for a drilling rig having a drawworks wherein the blow out preventer is transported between a storage area and a use position over a wellbore. The process includes the steps of connecting an upper connector end of an elongated running tool to the drawworks of the drilling rig. The elongated running tool is moved in position parallel to the wellbore using the drawworks of the drilling rig. The running tool is lowered so that a stab connection is made between a lower connector end of the running tool and the blow out preventer. The blow out preventer is thereafter moved over and in alignment with the wellbore.

15 Claims, 7 Drawing Sheets

BLOW OUT PREVENTER HANDLING SYSTEM

BACKGROUND OF THE INVENTION

1. Field of the Invention

The present invention provides a process and an apparatus to transport a blow out preventer for a drilling or workover rig having a drawworks between a storage area and a use position over a wellbore. In particular, the present invention provides a running tool in order to move a blow out preventer between a storage area and a use position using the existing drawworks of a rig.

2. Prior Art

Uncontrolled blow outs of gas or oil from a subterranean well caused by rapid influx of formation fluid in the well bore at high pressure is to be avoided. Accordingly, blow out preventers (or BOPs) have been developed over the years for use in the oil and gas industry to prevent blow outs in drilling, workover and production operations. Blow out preventers are a series of valves and other devices which are installed at the wellhead of a well. From time to time, it is necessary to move the BOPs between a storage area and a use position over the wellhead. BOPs are extremely heavy structures, often many tons in weight and bulky.

In ocean drilling operations, many different decks are utilized in a drilling rig at different vertical heights above the wellhead. The BOP will be connected to the wellhead of a well above sea level. The various decks are at different heights above the level of the wellhead. To move the blow out preventer into position for use and then back to a storage position, the blow out preventer must be moved horizontally in a confined space between a pair of decks and then moved vertically through various decks. In ocean drilling operations, the rig is subject to environment conditions, such as lateral forces from wind and waves.

Prior devices to handle and move blow out preventers have included dedicated BOP handling systems with their own winch and movement mechanisms.

For example, Bolding (U.S. Pat. No. 4,367,796) discloses a cart for handling guidelines which rides on a truck. A separate BOP transfer cart to support a BOP. When the load of the BOP is transferred to a drilling string, the BOP support cart is moved away.

It would be advantageous to develop a BOP handling system which utilizes the existing block and tackle drawworks of a drilling or workover rig.

It would also be advantageous to develop a BOP handling system which could move a BOP both vertically and rotationally as well as provide lateral restraint.

It would also be advantageous to develop a BOP handling system that provides lateral restraint against forces from environmental conditions such as wind and wave energy.

It would also be advantageous to develop a BOP handling system that provides quick and simple attachment to a BOP.

It would also be advantageous to develop a BOP handling system that utilizes existing drilling rig skidding systems for BOP horizontal movement.

SUMMARY OF THE INVENTION

The present invention provides a blow out preventer handling system for use with a drilling or workover rig having a number of decks or floors. Mounted on a drill floor would be a mast or derrick which will include a drawworks.

The drilling or workover rig sits above and around a wellhead which is in alignment with a wellbore. A blow out preventer will be moved and transported between two positions—a storage position wherein the blow out preventer is stored on one of the floors or decks of the drilling rig and a use position over and connected to the wellbore.

In order to transport the blow out preventer between a storage position and the use position, an elongated running tool is utilized. The elongated running tool is substantially cylindrical in shape and includes a lower section and an aligned upper section.

In accordance with the process of the present invention, the elongated lower section is initially moved into position-parallel to the wellbore using the drawworks of the drilling rig. In one preferred process, the lower section of the running tool will include a lower end having a BOP stab connector and an opposed upper end having a conical reduced diameter lifting sub. The lifting sub will be connected to elevators of the drawworks in order to raise the lower section.

Thereafter, the lower section of the tool will be lowered through a rotary table on the drill floor by the drawworks of the rig. The lower section includes a bearing bar opening through the upper end of the lower section. A rigid bearing bar will be inserted through the opening so that it is perpendicular to the tool lower section. The bearing bar will be brought to rest on the drill floor so that the lower section will be supported on the drill floor by the bearing bar. Thereafter, a centralizer dolly will be rolled into place across a diverter deck.

Thereafter, the upper section of the running tool will be brought into position from storage. The upper section includes a top end having a reduced diameter lifting sub and a lower end having a connector receptacle. The lifting sub of the upper section will be connected to the elevators so that the upper section will be brought parallel to the lower section and in axial alignment therewith.

Thereafter, the lower connector end of the upper section will be stabbed onto the upper lifting sub of the lower section. A plurality of fasteners will be used to secure the upper section to the lower section of the tool so that the entire running tool will be joined together. Using the drawworks to lift the tool, the load will be removed from the bearing bar and the bearing bar will thereafter be removed.

Continuing with the process, the BOP will be moved horizontally from a storage position on a BOP dolly. The entire running tool will be lowered by the drawworks so that the stab connector of the lower section will be received in the upper end of the BOP.

After the diverter deck centralizer dolly has been unlocked or unsecured, the drilling floor will be skidded using hydraulic cylinders so that the entire drilling floor will be moved horizontally to the well center or wellbore. This causes the running tool and its accompanying BOP to also be moved horizontally. The BOP will then be brought over, lowered and rotated if required. A stab connection will then be made between the BOP and the wellhead.

Once the BOP is connected to the wellhead, the running tool will be disconnected therefrom. The connector end of the lower section will be disconnected from a blow out preventer. Thereafter, the drawworks will be utilized to vertically raise the running tool. The reversed procedure will be performed to remove the running tool and return it to storage.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
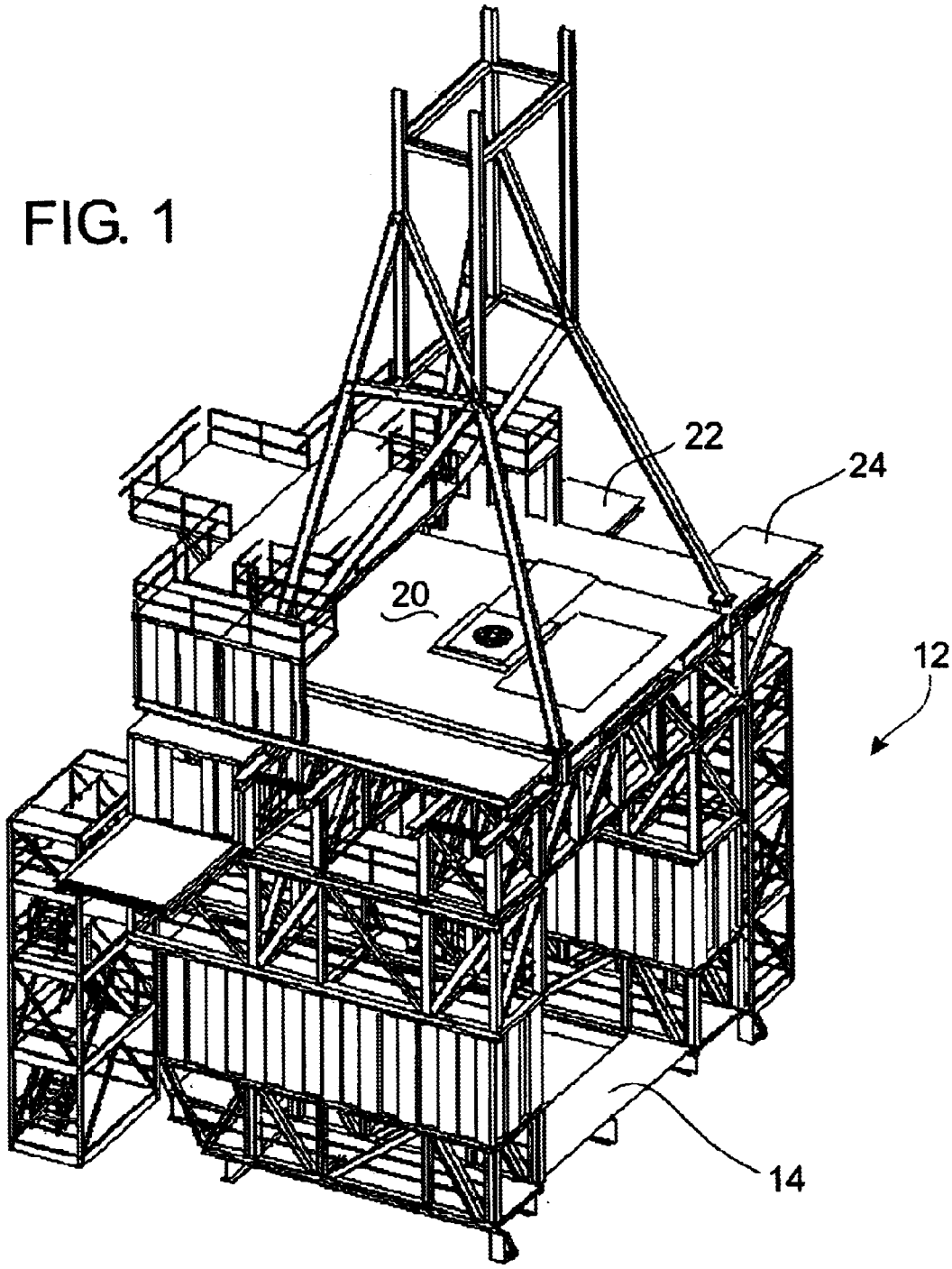
FIG. 1 is a partial perspective view of the drilling rig utilizing the blow out preventer handling system of the present invention.

Referring to the drawings in detail, FIG. 1 shows a partial view of a drilling rig 12 for ocean drilling operations with portions cut-away for clarity having a multiple number of decks or floors.

In FIG. 1, a lower skid frame deck 14 is visible. A number of intermediate decks or floors such as a shaker deck and a mud mixing house deck are likewise included. The drill floor 20 is capable of being moved horizontally using hydraulic cylinders. The drill floor 20 may be one hundred feet or more above the wellhead.

Mounted on the drill floor 20 would be a mast or derrick of the drilling rig which includes a drawworks (not seen in FIG. 1). As will be described in detail herein, the movement of the drill floor 20 is utilized to move a blow out preventer (BOP) horizontally. It will be understood that various arrangements of drilling rigs having various floors or decks may be employed within the scope of the present invention.

Figure 2:
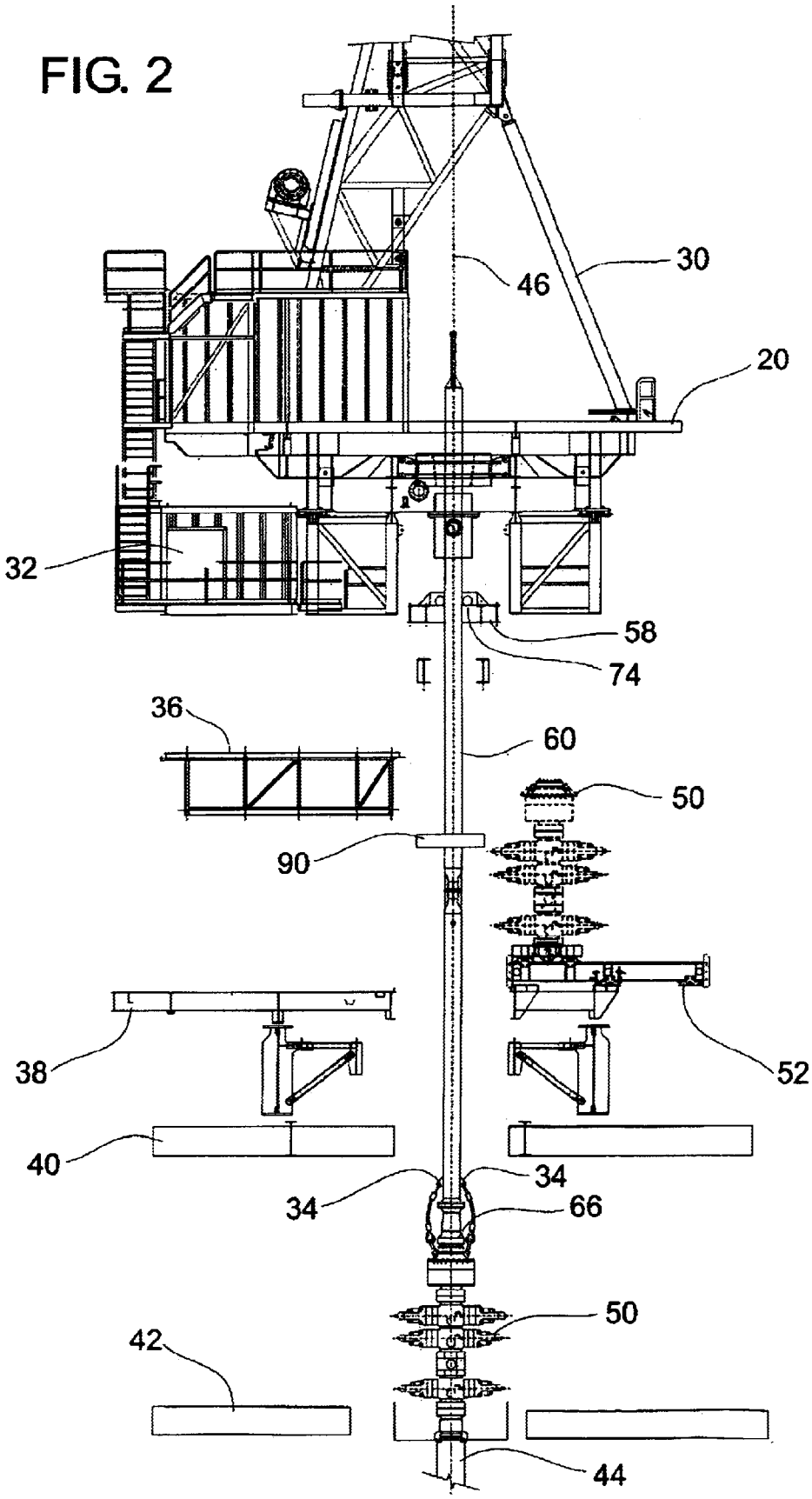
FIG. 2 is a partial, diagrammatic side view of the drilling rig shown in FIG. 1 utilizing the blow out preventer handling system as set forth in the present invention.

FIG. 2 illustrates a partial diagrammatic side view of the drilling rig 12 shown in FIG. 1 with the derrick or mast 30 mounted on the drill floor 20. The rig 12 will include a crown assembly and a drawworks such as a block and tackle arrangement. The drilling rig 12 also includes a mud mixing house 32 for mixing of drilling "mud" which is injected in the well, a shaker deck 36 for recycling drilling mud after use, a lower skid 38, a drill deck 40 and a production deck 42. Also shown is a wellhead 44 which is in alignment with a wellbore 46 (shown in dashed lines).

A blow out preventer 50 will be moved and transported between two positions—a storage position wherein the blow out preventer is shown in dashed lines on a BOP dolly 52 and a use position aligned with and connected to the well bore 44. In order to transport the blow out preventer 50 between the storage position and the use position, an elongated running tool 60 is utilized.

Figure 3:
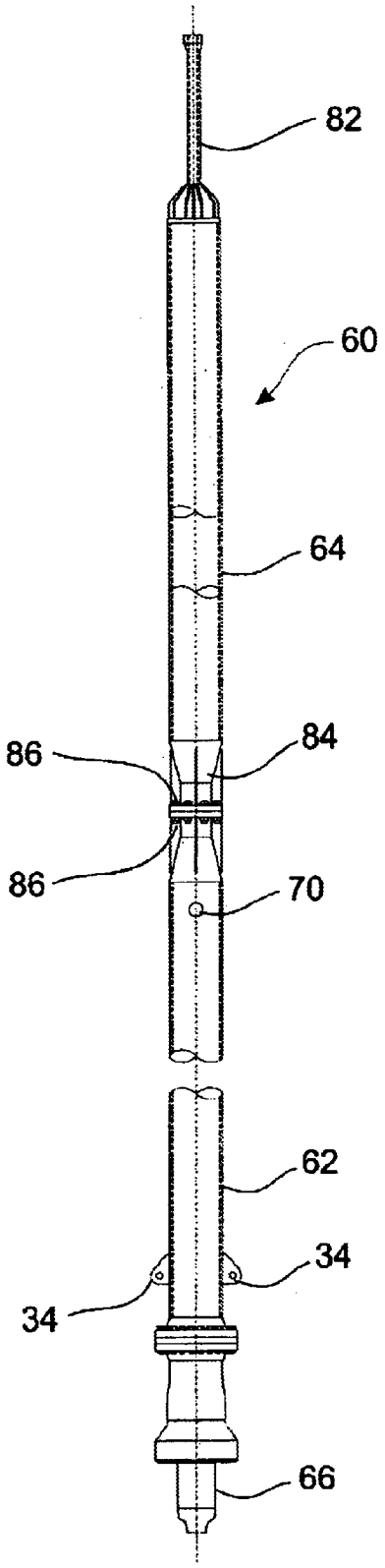
FIGS. 3 and 3A are side views of a running tool used as a part of the blow out preventer handling system of the present invention.
Figure 3A:
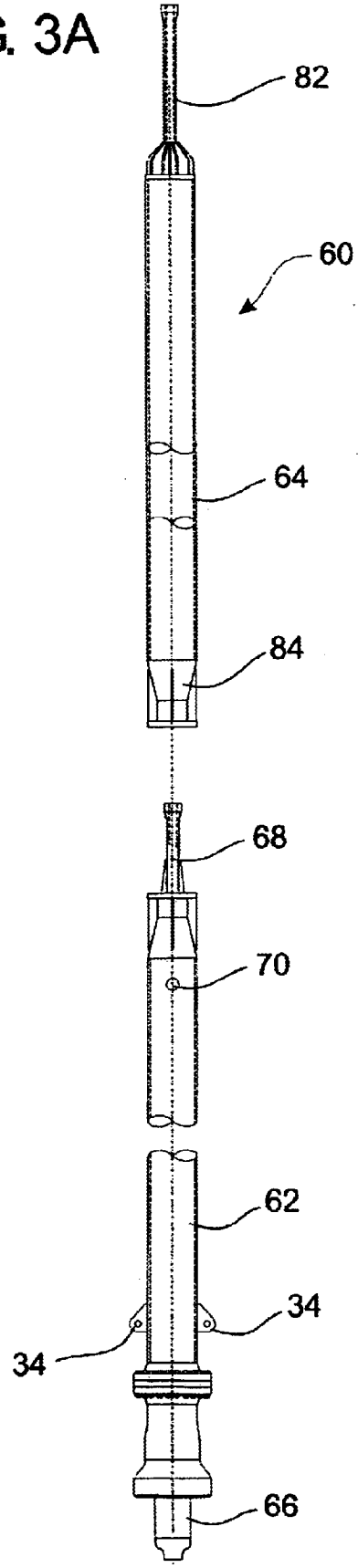

The elongated running tool 60 is substantially cylindrical in shape and is shown apart from the drilling rig 12 in FIG. 3. With reference to FIG. 3 and continuing reference to FIG. 2, the running tool 60 includes a lower section 62 and an axially aligned upper section 64. It will be understood that the running tool may be comprised of a single section or multiple sections within the scope of the present invention. In order to utilize the running tool 60 to transport and move the blow out preventer, a series of steps will be taken. The elongated lower section 62 is initially moved into position parallel to the wellbore using the drawworks of the drilling rig 12.

The lower section 62 will include a lower end having a BOP stab connector 66 that will stab on to a BOP (not shown in FIG. 3). A pair of pad eyes 34 extend from the lower section so that secondary safety cables may be attached to the BOP (see FIG. 2). The lower section 62 also includes an opposed upper end having a conical, reduced diameter lifting sub 68.

When not in use, the running tool sections may be stored in a horizontal position on the rig. Initially, the lower section 62 of the running tool 60 will be lifted from storage to the drill floor 20. The lifting sub 68 of the lower section 62 will be connected with the drawworks and, in particular, elevators attached to a block and tackle system. Additionally, a separate sling (not shown) moved by a crane or other device will lift the lower end of the lower section 62 near the stab connection 66. The drawworks will lift the upper end of the lower section 62 while the crane will move the lower section to tail-in the connector end 66. The process will move the lower section 62 so that it is parallel to the wellbore above the rotary table of the drill floor 20. Once the lower section is parallel to the wellbore, the sling or slings may then be disconnected.

Thereafter, the lower section 62 of the running tool will be lowered through a rotary table of the drill floor 20 by the drawworks. The lower section 62 includes a bearing bar opening 70 through the upper end of the lower section. The lower section will continue to be lowered until the bearing bar opening 70 is close to the drilling floor 20. Thereafter, a rigid bearing bar 72 will be inserted through the opening 70 so that it is perpendicular to the tool lower section 62.

Figure 4:
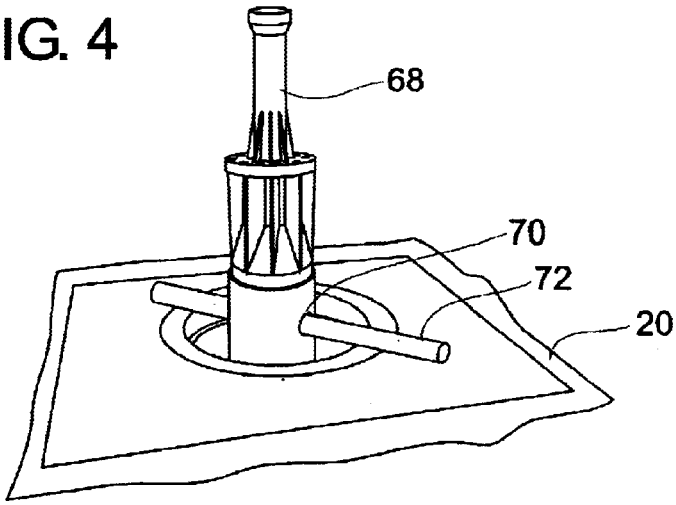
FIG. 4 is a partial perspective view of a lower section of the running tool shown in FIGS. 3 and 3A supported on the drill floor.

As best seen in FIG. 4, when the lower section continues to be lowered, the bearing bar 72 will rest on the drill floor and the lower section will be supported on the drill floor by the bearing bar. The drawworks will then lower the elevators so the load is removed. Once there is no load on the elevators, the elevators will be detached from the lower section to that the lower section is supported by the bearing bar on the drill floor.

Figure 5:
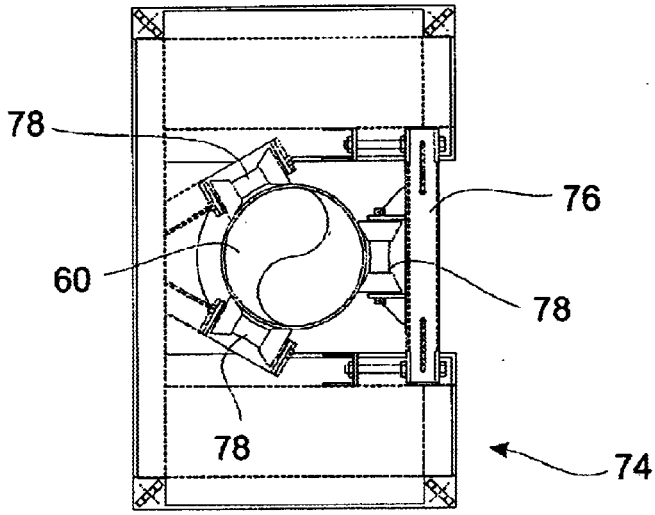
FIGS. 5, 6 and 7 illustrate a diverter deck centralizing dolly apart from the drilling rig.
Figure 6:
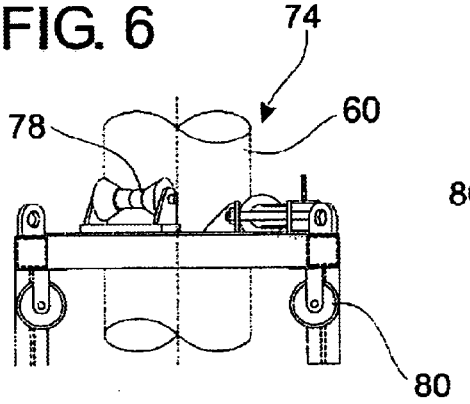
Figure 7:
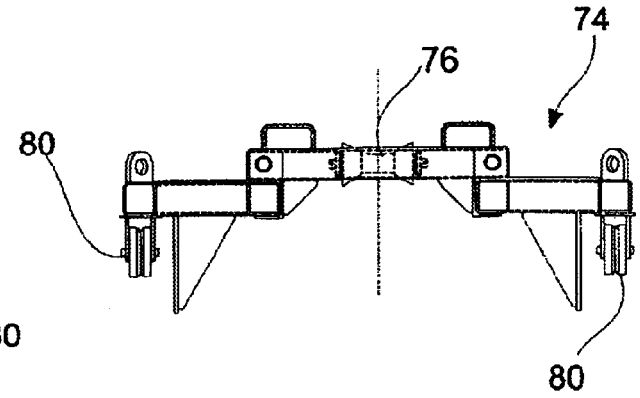
Figure 8:
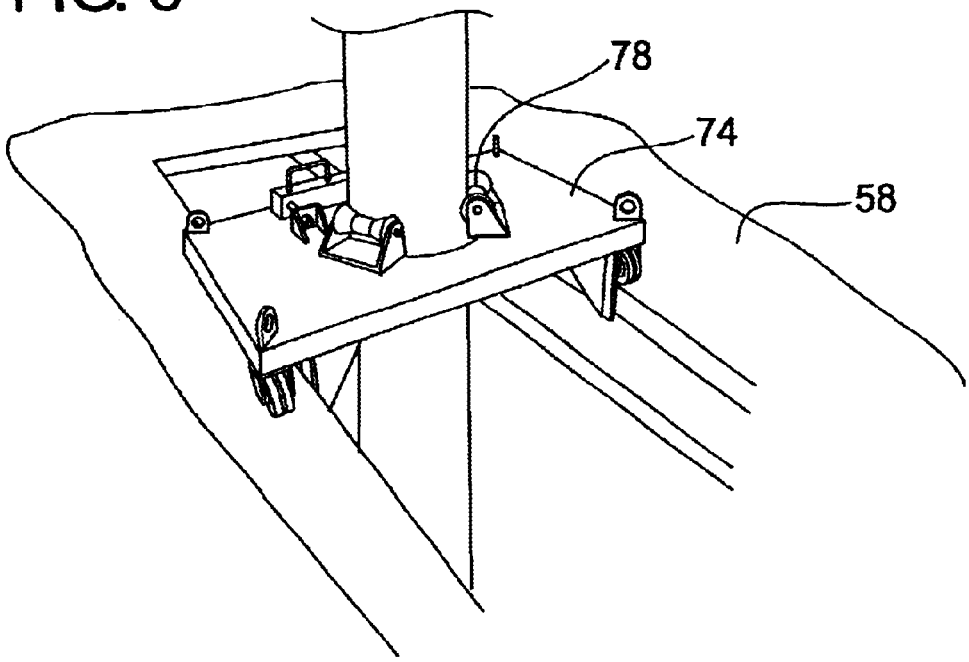
FIG. 8 illustrates the diverter deck centralizing dolly shown in FIGS. 5, 6 and 7 on a diverter deck of the drilling rig.

Thereafter, a diverter deck centralizing dolly 74 (shown in outline in FIG. 2) will be rolled into place to laterally restraint the running tool. The diverter deck centralizing dolly 74 is shown apart from the rig in FIGS. 5, 6 and 7 and shown in perspective view in FIG. 8. The diverter deck centralizing dolly 74 includes a plurality of wheels 80 which roll on and move across a track on a diverter deck 58 of the rig. The dolly 74 is U-shaped with an open side to receive the running tool 60. Once the dolly is in place, a closure bar 76 is closed to form an enclosure around the running tool 60. A series of rollers 78 engage and accommodate vertical movement of the running tool 60.

Continuing with the process to transport a blow out preventer in accordance with the present invention, the upper section 64 of the running tool 60 will next be brought into position. When not in use, the upper section 64 may be stored in a horizontal position on the rig. A sling or slings (not shown) will be utilized with a crane to lift the upper section to the rig floor. The top end of the upper section 64 includes a conical reduced diameter lifting sub 82 which is brought into position adjacent elevators of the drawworks. The elevators will be connected to the lifting sub 82 of the upper section. Thereafter, by hoisting the elevators vertically upward with the drawworks with the opposed bottom end of the upper section moving progressively toward the wellbore, the upper section 64 will be brought parallel to the lower section and in axial alignment therewith. The upper section 64 of the top will also be parallel to the wellbore.

Figure 9:
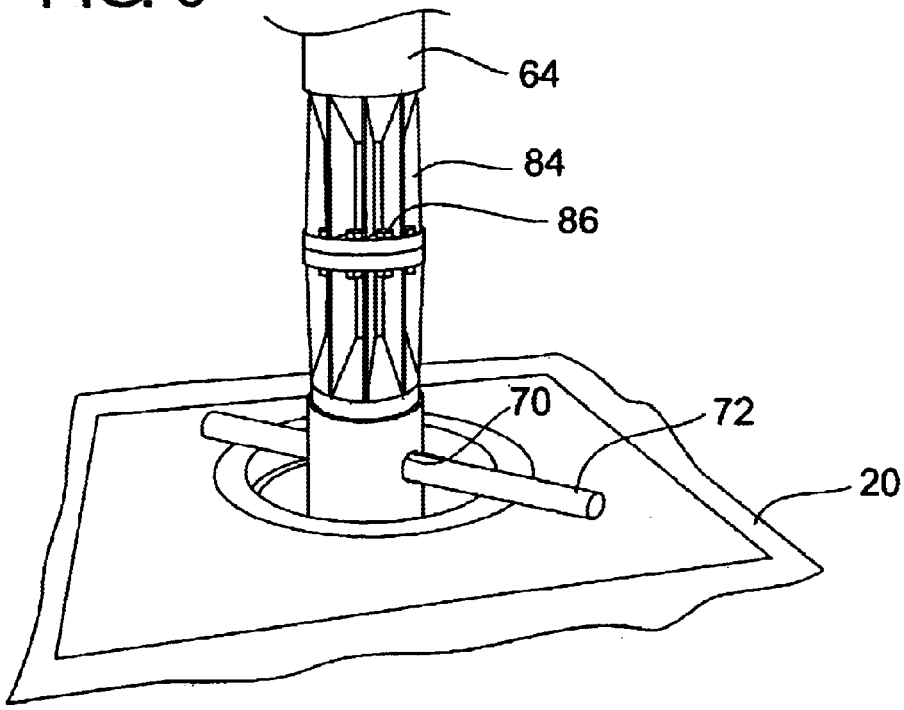
FIG. 9 illustrates the upper section and lower section of the running tool supported on the drilling floor.

The base of the upper section 64 includes a connector receptacle 84. As best seen in FIG. 9, the connector receptacle of the upper section will be stabbed onto the upper lifting sub 68 of the lower section 62. A plurality of fasteners 86 will be used to secure the upper section to the lower section of the tool so that the entire running tool will be joined together. By lifting the tool 60 with the drawworks, the load will then be removed from the bearing bar 72. Thereafter, the bearing bar 72 will be removed. The drawworks of the drilling or workover rig will then be used to raise the running tool 60 vertically.

Figure 10:
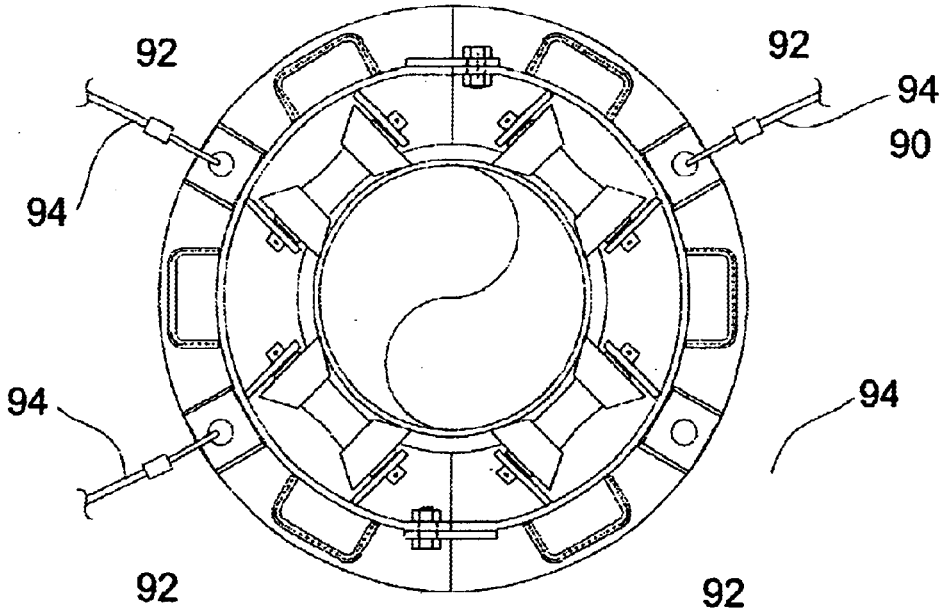
FIGS. 10 and 11 illustrate a floating centralizing assembly apart from the drilling rig.
Figure 11:
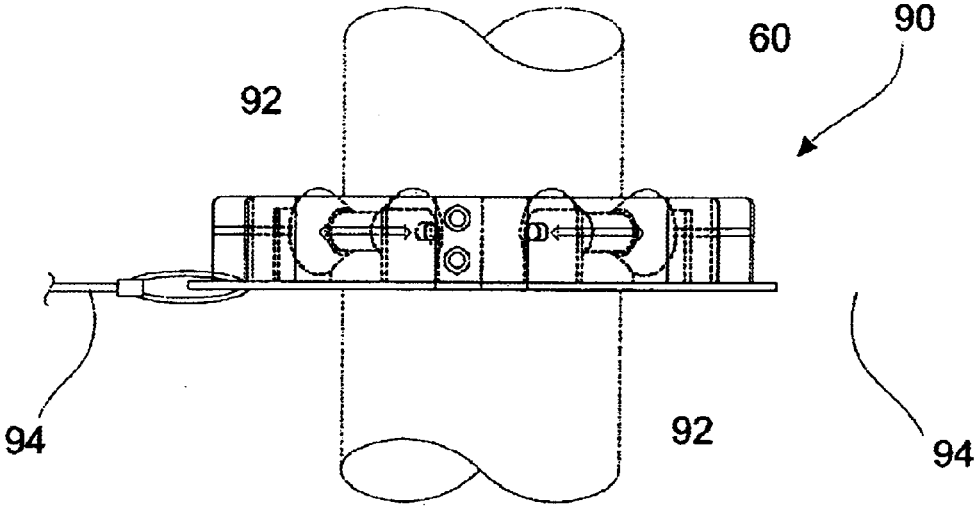

Returning to a consideration of FIG. 2, a floating centralizer assembly 90 may also be employed to restrain lateral movement of the tool (shown in outline in FIG. 2). The centralizer assembly 90 is shown apart from the rig in FIGS. 10 and 11. It includes a series of rollers 92 mounted on a frame which engage the tool 60. Horizontal wireline connectors 94 extending between the centralizer assembly and the rig and hold the assembly 90 in place.

Figure 12:
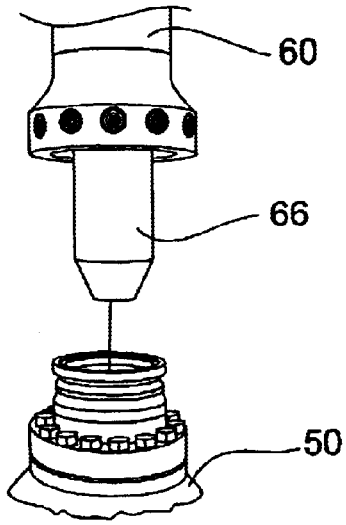
FIG. 12 illustrates a partial view of the connection between the running tool and the blow out preventer.
Figure 13:
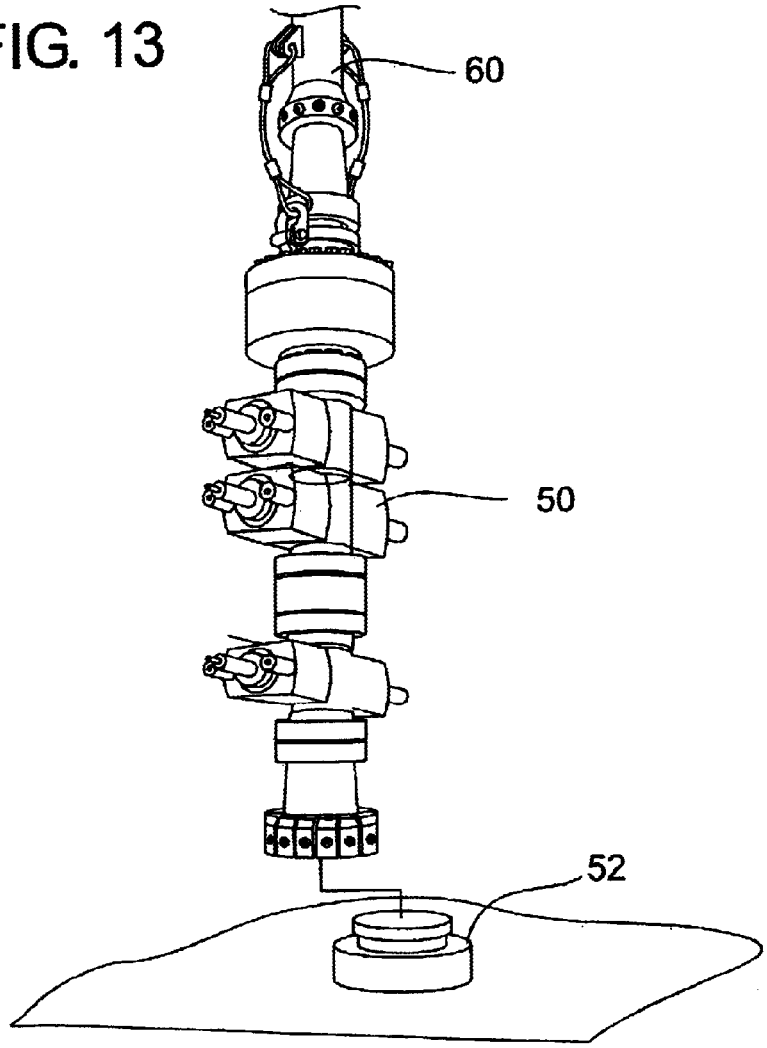
FIG. 13 illustrates the running tool and blow out preventer positioned apart from a BOP dolly.

When not in use, the BOP 50 will be stored on one of the decks of the rig. The BOP will be moved horizontally from a storage position on the BOP dolly 52 (not shown in FIG. 2). As seen in FIG. 12, the entire running tool 60 will then be lowered so that the stab connector 66 of the lower section will be received in the upper end of the BOP. By fasteners or other mechanisms, the BOP 50 is joined with the stab connection to the running tool. As best seen in FIG. 13, the BOP 50 is then unfastened from its storage position on the BOP dolly 52 and lifted up utilizing the running tool 60.

Thereafter, it is necessary to unlock or unsecure the diverter deck centralizing dolly 74 from the diverter deck. Once this has been accomplished, the entire drilling floor 20 is moved horizontally to the well center 46. This also causes the running tool 60 and its accompanying BOP 50 to be moved horizontally. After skidding the tool 60 to the wellbore center 46, the diverter deck centralizing dolly is again secured or locked to the diverter deck. The BOP is then aligned over the wellhead 44. If required, the BOP may also be rotated by rotating the running tool 60 which may be accomplished by a top drive, a rotary drive or other means. The BOP will then be brought over and lowered and connection will be made with the wellhead 44.

Once the BOP is connected to the wellhead 44, the running tool 60 will be disconnected from the BOP 50. The connector end 66 of the lower section 62 will be disconnected from the BOP 50. Thereafter, the drawworks will be utilized to vertically raise the running tool 60. The reverse procedure will then be performed. The running tool 60 will be raised so that the bearing bar opening 70 will be above the drilling rig deck 20. The bearing bar 72 will be inserted through the bearing bar opening 70 so that the running tool can be supported on the drilling deck. Thereafter, the upper section 64 will be unfastened and disconnected from the lower section 62. The upper section can be raised away and, with the assistance of a crane or other device, the upper section can be returned to a storage position.

Thereafter, the lower section 62 of the tool may be raised by the drawworks, the bearing bar 70 removed and the lower section raised and moved away to a storage position.

In order to move the BOP 50 from a use position at the wellhead back to a storage position on a deck, the reverse procedure is performed.

Whereas, the present invention has been described in relation to the drawings attached hereto, it should be understood that other and further modifications, apart from those shown or suggested herein, may be made within the spirit and scope of this invention.

What is claimed is:

1. A process to transport a blow out preventer for a drilling or workover rig having a drawworks between a storage area and a use position over a wellbore, which process comprises the steps of:

connecting an upper connector end of an elongated running tool to said drawworks of said drilling rig wherein said running tool has a cylindrical surface with a constant outside diameter along a length of said tool engageable by rollers of a deck supported centralizing dolly and floating centralizing assembly;

moving said elongated running tool into position parallel to said wellbore using said drawworks of said drilling rig;

lowering said running tool so that a stab connection is made between a lower connector end of said running tool and said blow out preventer;

moving said blow out preventer over and in alignment with said wellbore; and restraining lateral movement of said blow out preventer with said deck supported centralizing dolly and floating centralizing assembly by said rollers which engage said cylindrical surface of said running tool.

2. A process to transport a blow out preventer as set forth in claim 1 wherein said steps are performed in reverse order.

3. A process to transport a blow out preventer as set forth in claim 1 including the additional subsequent steps of:

connecting said blow out preventer to a well head at said wellbore; and thereafter disconnecting said running tool from said blow out preventer.

4. A process to transport a blow out preventer as set forth in claim 1 wherein said elongated running tool includes a tool lower section and a tool upper section and wherein said process includes an additional step of joining said lower section and said upper section together.

5. A process to transport a blow out preventer as set forth in claim 1 wherein said drawworks includes a top drive and elevators which connect with said upper connector end of said running tool.

6. A process to transport a blow out preventer for a drilling or workover rig having a drawworks between a storage area and a use position over a wellbore, which process comprises the steps of:

moving an elongated tool lower section into position parallel to said wellbore using said drawworks;

moving an elongated tool upper section into position parallel to said wellbore and over said lower section;

joining said tool lower section and said tool tipper section together wherein said tool sections have cylindrical surfaces with a constant outside diameter along a length of said tool engageable by rollers of a deck supported centralizing dolly and floating centralizing assembly;

connecting said tool lower section to said blow out preventer;

moving said elongated tool and said connected blow out preventer in position over and in alignment with said wellbore; and restraining lateral movement of said blow out preventer with said deck supported centralizing dolly and floating centralizing assembly by said rollers which engage said cylindrical surface of said running tool.

7. A process to transport a blow out preventer as set forth in claim 6 wherein said steps are performed in reverse order.

8. A process to transport a blow out preventer as set forth in claim 6 including the additional subsequent steps of:

connecting said blowout preventer to a wellhead at said wellbore; and thereafter disconnecting said tool from said blowout preventer.

9. A process to transport a blow out preventer as set forth in claim 6 wherein said upper tool section includes a lifting sub which will be connected to elevators of a hoisting assembly, said lifting sub having a conical, reduced diameter end.

10. A process to transport a blow out preventer as set forth in claim 9 wherein the step of connecting said lower tool section to said blow out preventer includes a stab connection between said lower section and said blow out preventer.

11. A process to transport a blow out preventer as set forth in claim 6 wherein said step of moving said elongated tool includes rotating said tool.

12. A blow out preventer handling tool for a drilling or workover rig having a drawworks and a wellbore, which tool comprises:

an elongated tool upper section having an upper connector end to connect to said drawworks and a lower end;

a deck supported centralizing dolly and floating centralizing assembly having rollers; and an elongated tool lower section having a lower connector end making a stab on connection with a blow out preventer and an upper end to connect with said lower end of said upper section wherein said upper section and said lower sections have cylindrical surfaces with a constant outside diameter along a length of said tool which engage said rollers of said deck supported centralizing dolly and floating centralizing assembly.

13. A blow out preventer handling tool as set forth in claim 12 wherein said lower tool section includes extending pad eyes to connect secondary safety cables between said tool and said blow out preventer.

14. A process to transport a blow out preventer for a drilling or workover rig having a drawworks between a storage area and a use position over a wellbore, which process comprises the steps of:

connecting an upper connector end of an elongated running tool to said drawworks of said drilling rig wherein said running tool has an opening therethrough to receive a bearing bar;

moving said elongated running tool into position parallel to said wellbore using said drawworks of said drilling rig;

lowering said miming tool so that a stab connection is made between a lower connector end of said running tool and said blow out preventer; and moving said blow out preventer over and in alignment with said wellbore.

15. A process to transport a blow out preventer for a drilling or workover rig having a drawworks between a storage area and a use position over a wellbore, which process comprises the steps of:

moving an elongated tool lower section into position parallel to said wellbore using said drawworks;

passing a bearing bar through an opening in said tool lower section and suspending said lower section from a floor or deck of said rig;

moving an elongated tool upper section into position parallel to said wellbore and over said lower section;

joining said tool lower section and said tool upper section together;

removing said bearing bar from said opening in said tool lower section;

connecting said tool lower section to said blow out preventer; and moving said elongated tool and said connected blow out preventer in position over and in alignment with said wellbore.

* * * * *